US005303901A

United States Patent [19]

Bock et al.

[11] Patent Number: 5,303,901

[45] Date of Patent: Apr. 19, 1994

[54] BLOWING LANCE WITH CYCLIC MODULATOR MEANS FOR VARYING FLOW RATE

[75] Inventors: Andre Bock, Beethovan; Robert Mousel, Dudelange; Patrick Bintner, Luxembourg, all of Luxembourg

[73] Assignee: Arbed S.A., Luxembourg, Luxembourg

[21] Appl. No.: 968,974

[22] Filed: Oct. 30, 1992

[30] Foreign Application Priority Data

Oct. 30, 1991 [LU] Luxembourg ..... 88023

[51] Int. Cl.[5] ..... C21C 5/32

[52] U.S. Cl. ..... 266/225

[58] Field of Search ..... 266/225, 266

[56] References Cited

U.S. PATENT DOCUMENTS 4,043,799 8/1977 Carlomagno et al. ..... 266/225
4,993,691 2/1991 Mousel et al. ..... 266/225

FOREIGN PATENT DOCUMENTS 0364722 4/1990 European Pat. Off. .
0490101 6/1992 European Pat. Off. .
1346214 11/1963 France .
7331959 4/1974 France .
885287 11/1981 U.S.S.R. ..... 266/225
1060686 11/1981 U.S.S.R. .

*Primary Examiner*—Melvyn J. Andrews
*Attorney, Agent, or Firm*—Fishman, Dionne & Cantor

[57] ABSTRACT

A blowing lance for refining metals by blowing a gas onto a surface of a metal bath is presented. This lance has an adjustable tuyere for generating a supersonic refining gas flow and a blowing head with a set of fixed tuyeres opening into a front dome of the blowing head and dividing the supersonic gas flow into individual free jets. A cyclic modulator modulates a flow rate through the set of fixed tuyeres so that the flow rate in a first subset of tuyeres does not vary synchronously with the flow rate in a second subset of tuyeres, i.e., the flow rates in both subsets of tuyeres increase or decrease at the same time and they do not reach their minimum value or their maximum value at the same moment.

21 Claims, 4 Drawing Sheets

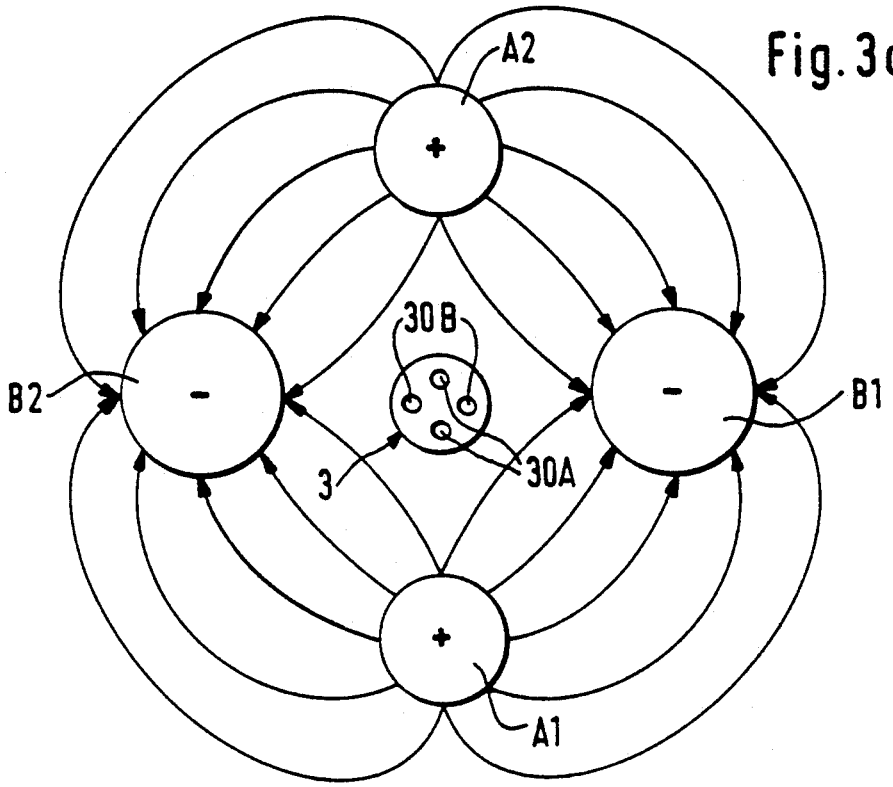
Fig. 3a
Fig. 3b
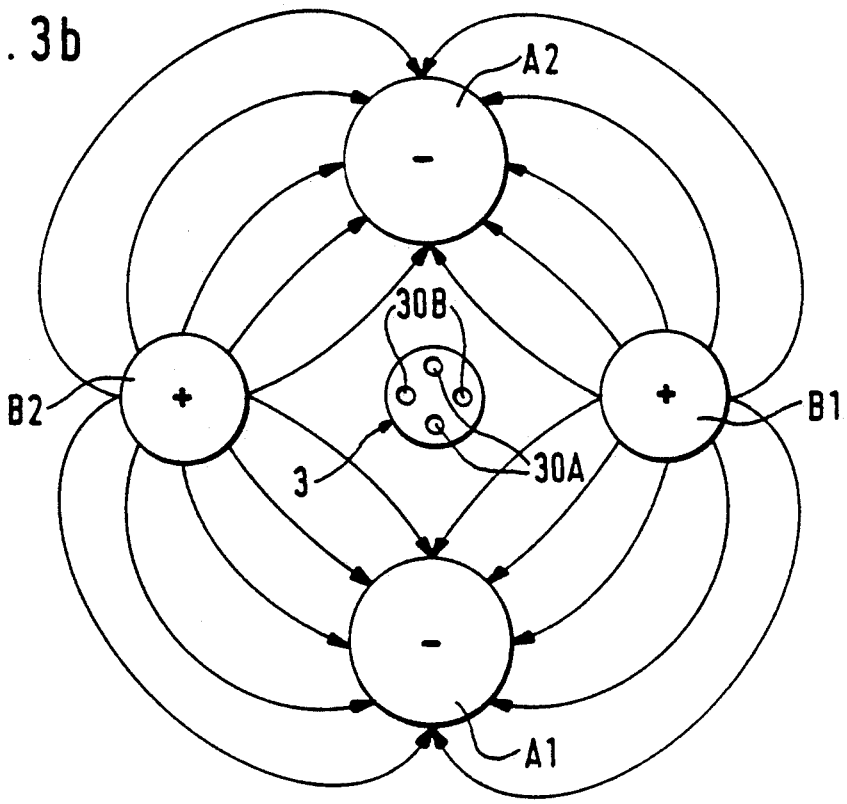

Fig. 4a
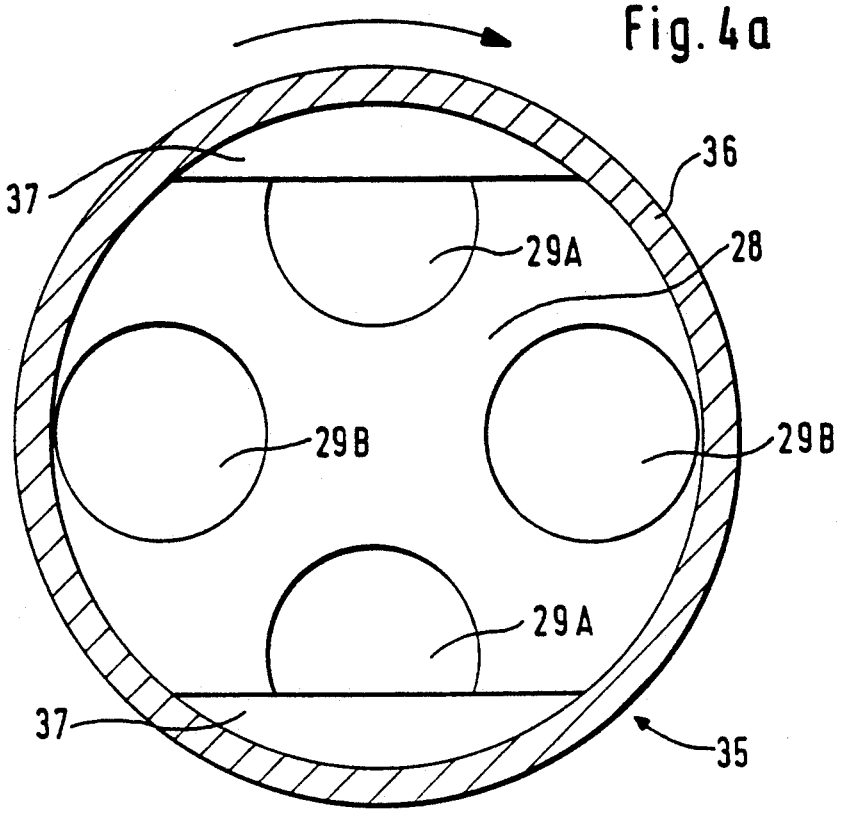
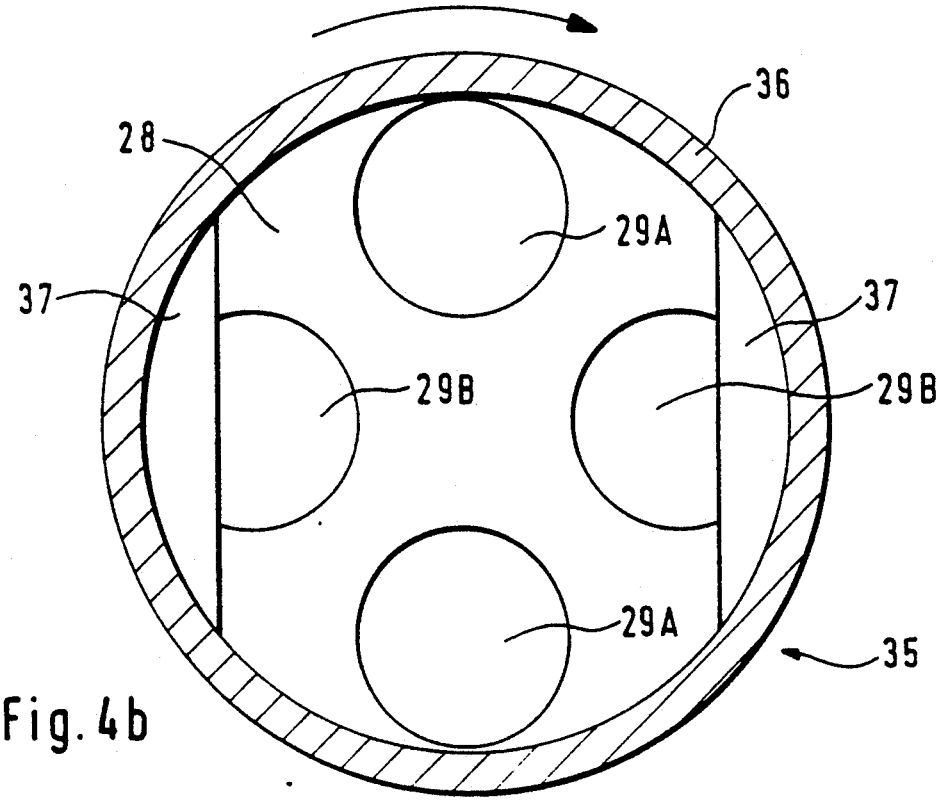
Fig. 4b

BLOWING LANCE WITH CYCLIC MODULATOR MEANS FOR VARYING FLOW RATE

BACKGROUND OF THE INVENTION

The present invention relates to blowing lances, and more particularly to blowing lances used in the refining of a metal by blowing a gas onto the surface of a molten metal bath.

During a refining process, for example during the refining of cast iron or of an iron compound, a refining gas, mostly oxygen, is blown from above onto a molten metal bath.

A blowing lance for blowing from above onto the molten metal bath during a refining process is known. The lance includes a head with nozzles which generate up to 4 or 6 supersonic refining gas jets which impinge on the bath surface at predetermined impact spots. Such a lance is generally characterized by a gas flow rate, which is dependent on the supply pressure of the gas, and by a supersonic gas outflow speed, which is a function of the same supply pressure. In the course of the following description, a lance of this type will be designated by the expression "a conventional lance".

Different techniques have been developed for intensi7 fying the stirring of the metal bath, and bringing continuously new molten metal into contact with an oxidizing gas, avoiding the occurrence of an oversaturation of the oxidizing gas in the bath and for avoiding a local overheating at the impact of the jets.

One such technique is disclosed in Luxembourg Patent No 87 855 (corresponding to U.S. patent application, Ser. No. 803,167, both of which are assigned to Paul Wurth S.A., a Corporation of Luxembourg and which are incorporated herein by reference) which discloses a blowing lance for generating an even number of gas jets where the impingement spots on the surface of the molten metal bath can be rotated in a continuous manner along a circular path during the refining operation. If compared to the above-mentioned conventional lance, this lance distinguished itself by providing a better stirring of the metal bath, by an improved spreading of the oxidizing gas and by a better repartition of the reaction heat in the vicinity of the impact spots of the jets. A head of this lance, according to U.S. patent application Ser. No. 803,167, includes a rotating part or rotor, which is exposed directly to the heat and to the splashes of the bath, but which, presently can not be integrated into the cooling circuit of the lance. As a result, this blowing lance head has a substantially shorter lifetime than the head of a conventional blowing lance, for which the cooling of the static terminal dome section, with fixed tuyeres therein, can easily be achieved.

Another technique, well known in conjunction with the LD-CL Process (CL=Circulating Lance), makes use of an inclined lance body able to circulate around a vertical axis, so as to sweep or scan the surface of the bath with one jet or with a plurality of jets. This LD-CL lance shows advantages which are similar to those mentioned for the lance with rotating jets of U.S. patent application Ser. No. 803,167. The implementation of the circulating lance requires however important mechanical means as well as a complete transformation of the suspension equipment for the lances.

Luxembourg Patent No 87 353 (corresponding to U.S. Pat. No. 4,993,691), both of which are incorporated herein by reference, discloses an adjustable Laval tuyere which allows, generating within a blowing lance, a supersonic gas flow where the speed and the flow rate are adjustable independently of one another. It is therefore possible to obtain with this device jets of varying hardness (or penetration) for different flow rates.

A conventional lance, equipped with such an adjustable Laval tuyere, provides of course the possibility of increasing the flow rate of the oxidizing gas during the refining operation and to thus intensify the stirring of the bath. However, a conventional lance used in combination with a Laval tuyere has several drawbacks, e.g., during use, an overconcentration of the oxidizing gas in the bath may result and/or a local overheating of the bath at the impingement points of the jets on the bath may also result.

SUMMARY OF THE INVENTION

The above-discussed and other drawbacks and deficiencies of the prior art are overcome or alleviated by the blowing lance of the present invention. In accordance with the blowing lance of the present invention, a lance for refining metals by blowing a gas onto the surface of a metal bath, comprises an adjustable tuyere which generates a supersonic refining gas flow where the flow rate and the speed are independently adjustable. The blowing lance also includes a blowing head with a set of fixed tuyeres opening into a front dome of said blowing head and dividing the supersonic gas flow into individual free jets. The present invention allows the intensifying of the stirring of the bath without increasing the risk of overheating of the metal bath or of overconcentration of the oxidizing gas at the spots where the jets are impinging on the bath. The blowing lance further includes a cyclic modulator for varying the flow rate through the set of fixed tuyeres by progressively obturating a first subset of the fixed tuyeres for the passage of the gas and for simultaneously and progressively freeing a second subset of the fixed tuyeres for the passage of the gas during the first part of a modulation cycle and vice versa during the second part of the modulation cycle.

The blowing lance cyclically modulates the flow rate of the individual jet between a minimum value and a maximum value, so that the flow rate in certain of the jets does not vary synchronously with the flow rate in the remaining jets, that is to say the flow rates do not increase or decrease at the same time and they do not reach their minimum value or their maximum value at the same moment.

During operation, the blowing lance develops a specific fluid motion in the bath with the help of a plurality of gas jets which have fixed impingement points on the bath surface. This fluid motion specifically increases the afflux of the molten material towards said fixed impingement points of the jets. The stirring of the bath is improved, without giving rise to overconcentrations of the oxidizing gas in the bath and/or to a local overheating at the spots where the jets are striking the bath.

A more detailed explanation of the lance operation on a molten metal bath in accordance with the present invention is described below.

A gas jet striking the surface of a liquid displaces from its impact spot a volume liquid and it creates in this way a depression in the surface of the liquid. The volume of the liquid displaced by a jet is a parameter which is increasing mainly with the flow rate of the jet. It follows therefrom that if the flow rate of the gas increases, the volume of the depression grows and the impact zone of the jet becomes a source generating a flow of liquid which is driven out of the impact zone.

If, on the other hand, the flow rate of a gas jet decreases, the depression created in the surface of the liquid is filled up, under the influence of gravity, and the impact zone of the jet is becoming in this way a sink generating a flow of liquid which moves towards the impact zone of the jet.

It also follows that if the flow rate of a jet is modulated between a minimum value and a maximum value it generates a more important stirring of the liquid than a jet with a steady flow rate equalling the integrated average of the modulated flow rate.

By juxtaposing sources and sinks, this is to say the jets with an increasing flow rate and those with a decreasing flow rate, one succeeds in intensifying the movements of the liquid in the bath. One creates indeed a kind of "fluid motors", which are composed of cyclically reversible couples of a source and a sink creating alternating flows of material between the impact zones of the modulated jets.

As a consequence the stirring of the bath is considerably increased as compared to a lance with non-modulated fixed jets dispensing the same flow rate of refining gas.

Industrial practice has shown that the results achieved with a lance working according to the above explained principle are at least equivalent to the results obtained with the lances with revolving jets.

As a result of an appropriate choice of the frequency and of the modulation function (i.e., the evolution of the flow rates with time and the shifting of the cycles between the individual jets) one has moreover succeeded in producing superposition phenomenon of fluid motion in the bath, thus creating a fluid motion with a resonance character. These phenomenons further increase the motion of the material in the bath and they have a positive influence on the cinetics of the metallurgical reactions as well as on the melting of scrap which might be added to the bath.

The manner in which the flow rate varies in the various jets is a function of the characteristics, as for example the geometrical configuration, of the means used to achieve the cyclic modulation of the flow rate of each individual jet.

It will e.g., be appreciated that it is possible to have a total instantaneous flow rate of all the jets that is nearly constant.

It might for example be of advantage to create couples of jets whereof one jet has a maximum flow rate at the moment when the other jet has a minimum flow rate, or vice versa.

It might also be of advantage to choose the geometrical distribution of the jets and the cyclic distribution of the flow rates in such a way, that the horizontal components of the dynamic forces acting on the lance, and which are due to an inclination of the jets, show a zero resultant at any moment of the cycle.

The above-discussed and other features and advantages of the present invention will be appreciated and understood by those skilled in the art from the following detailed description and drawings.

BRIEF DESCRIPTION OF THE DRAWINGS

Referring now to the drawings, wherein like elements are numbered alike in the several FIGURES.

FIG. *3a* and FIG. *3b* show each a plan view of the impact points on the surface of the bath during the first and the second half of a cycle; and FIG. *4a* and FIG. *4b* show a section AA through the modulating device during the first and the second half of a cycle.

DESCRIPTION OF THE PREFERRED EMBODIMENT

Figure 1:
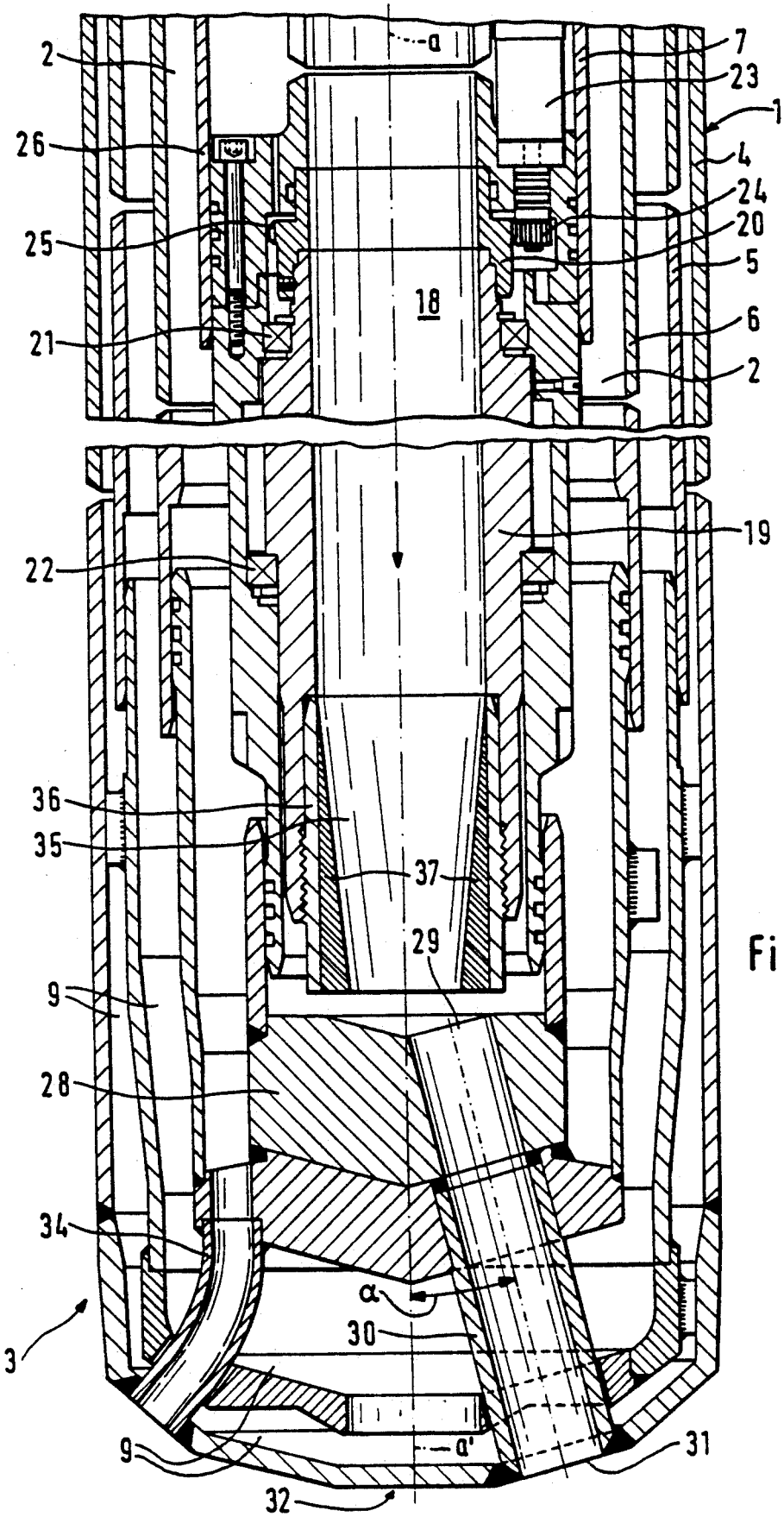
FIG. 1 shows a longitudinal cross sectional view, following two perpendicular plans, of the blowing head belonging to a lance according to the present invention.
Figure 2:
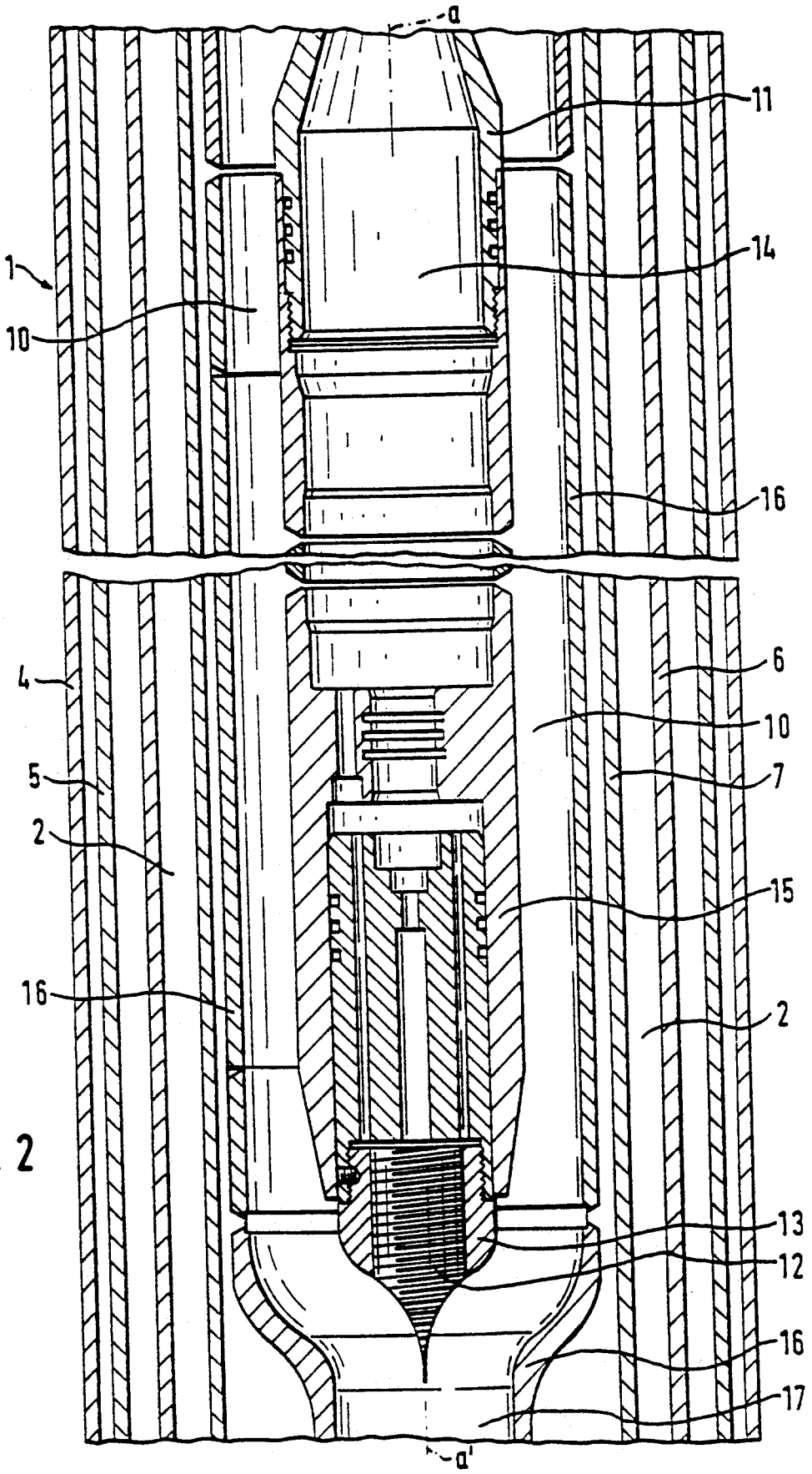
FIG. 2 shows a longitudinal cross sectional view, following two perpendicular plans, of the adjustable Laval tuyere belonging to a lance according to the present invention.

Referring to FIGS. 1 and 2, the proposed blowing lance 1 comprises a lance body 2 welded to a blowing head 3. The lance body 2 includes a mantle comprising four coaxial sleeves 4, 5, 6 and 7 for example four welded steel pipes. The sleeves are kept spaced apart with the help of spacers and they are linked to the head 3 of the lance so as to delimit a water cooling circuit 9 between the sleeves 4, 5, 6 and 7 of the mantle and the walls of the blowing head 3.

It will be understood that the blowing lance of the present invention requires the suspension of the lance assembly and the feeding sources supplying the fluids, namely oxygen and nitrogen as well as cooling water which are not shown.

The inner wall of the conduit 16 in the lance body 2 delimits an annular chamber 10, defining a longitudinal axis a-a'. A supporting rod 11 is coaxial to the axis a-a' and is supporting a whole assembly constituting a part of an adjustable tuyere 12 such as a Laval tuyere which is described in U.S. Pat. No. 4,993,691. The supporting rod 11 comprises preferably of a tube which allows the incorporation of electrical cables (not shown) for supplying electrical current to the various control mechanisms which will be described at a later stage. According to another embodiment, the supporting rod 11 and the inner wall may themselves be used as electrical conductors feeding the electrical courant to said control mechanisms.

The Laval tuyere 12 further includes a translation body 13 connected to the support rod 11 through the intermediary of a control mechanism comprising a linear step by step motor 14 and a cylindrical sleeve 15. Within this sleeve 15 the translation body 13 can move up and down along the axis a-a' of the blowing lance 1. As can be seen in FIG. 2, the end of the translation body 13 has the shape of a kind of needle whereof the profile follows a continuous aerodynamical transition curve, so as to reduce to a minimum the generation of turbulences in the stream of the refining gas.

Within the mantale 7 of the lance body 2 is arranged a coaxial conduit 16 for the refining gas, namely the primary oxygen. At the height of the translation body 13, the coaxial conduit 16 comprises one part 17 made up of a converging part and of a neck which extends into a cylindrical conduit. The converging part and the fixed neck form, together with the needle of the translation body 13, an adjustable Laval tuyere 12. The characteristics or parameters of this Laval tuyere 12 can be modified by shifting the translation body 13 in the direction of the axis a-a'. This Laval tuyere allows the control of the flow rate of the refining gas independently from the supersonic speed of the jet of refining gas at the outlet of the Laval tuyere 12. The operation of the adjustable Laval tuyere 12 has been specified more in detail in U.S. Pat. No. 4,993,691.

Downstream with respect to part 17 of the conduit 16 conveying the refining gas, the blowing lance 1 includes, according to the present invention, a cyclic modulator 18 (see FIG. 1) located centrally in the supersonic flow of refining gas.

The cyclic modulator 18 is located above an inlet piece 28 provided with four inlets 29. Inlets 29 function to divide the main supersonic flow of the refining gas in an aerodynamically correct manner into four supersonic jets, whereof the flow rates would be nearly the same in the absence of the cyclic modulator 18.

Four fixed tuyeres 30, which have a constant cross section, start from piece 28 and they reach down to the terminal dome 32 of the lance head wherein they delimit four outlet orifices 31. While four fixed tuyeres are shown herein, it will be understood that any number of fixed tuyeres may be utilized.

The aforementioned four outlets 31 are spaced apart by an angle of 90° on a circumference having its center on the axis a-a' of the lance 1. While a 90° space is depicted for four outlets 31 and inlets 29 it will be understood that for any number of outlets 31, it is advantageous to provide generally an equal space between those outlets, e.g. for a total of eight outlets, a space of approximately 45° between them would be advantageous. The axis of the fixed tuyeres 30 are consequently inclined by an angle $\alpha$ with respect to said axis a-a' of the lance. The choice of this angle is, among other factors, a function of the geometry of the vessel and of the distance of the head of the lance above the bath. Generally, the angle $\alpha$ may be between 10° and 15°.

The cyclic modulator 18 functions as a kind of rotor and has an upper cylindrical part 19 which is suspended to a supporting device 20 including an upper bearing 21 and a lower bearing 22. In this embodiment the upper bearing 21 and the lower bearing 22 of the cyclic modulator 18 are roller bearings having housings which are fixed in a tight by removable manner to the wall 7 of the lance body 2. The fixing means can be different from those shown in FIG. 1, which indeed constitute only a preferred embodiment.

One or several servomotors 23, located between the wall 7 of the lance body 2 and the conduit 16, confer a rotating movement to the cyclic modulator 18 where the angular speed can be regulated.

In view of the rotation, the shaft of the servomotor 23 is provided with a pinion 24 which is operating a toothed ring 25 mounted on the supporting and moving device 20.

Connectors for supplying electricity and control signals to the servomotors 14 and 23 are located between the wall 7 and the conduit 16 although they have not been shown on the figures. It should be noted that the space between the wall 7 and the conduit 16 is advantageously filled with a neutral gas, such as nitrogen. This gas is advantageously kept under a slight overpressure with respect to the refining gas (e.g., oxygen) flowing through the central duct of the lance 1. This measure guarantees that any penetration of the oxygen, liable to cause ignitions in the servomotors and in their connectors, is avoided. In order to avoid statical electrical discharges between the different elements, mainly between the rotor and the fixed parts, equipotential measures, such as connectors 26, are foreseen.

The cyclic modulator 18 includes upper cylindrical part 19 and a rotary obturator 35, these parts being preferably connected one to another, so as to allow an easy dismanteling. The upper cylindrical part 19, which has a cylindrically shaped interior, extends over a given distance in said lance and, in spite of being subject to a rotating movement, it forms a stabilizing distance for the supersonic flow of the refining gas. The rotary obturator 35 is installed above the four inlets 29 provided in the piece 28.

According to a preferred embodiment of the rotary obturator 35, the latter comprises a tube 36 wherein are fixed two symmetrical pieces 37 at diametrically opposed locations. The inner diameter of the tube 36 is preferably chosen so that the projection of an inner section of tube 36 on the inlet piece 28 completely covers said four inlets 29, and that the contour of the projection is tangential to the four inlets 29. The shape of the pieces 37 can be described as being obtained by cutting, along an oblique plan, a full solid cylinder which has the same inner diameter and height of the tube 36. The section is operated in such way that the intersecting plan is tangential to one base of the cylinder and that it cuts off from the other base of the cylinder a circular segment having an opening angle of approxi7 mately 90° (see FIG. 4). While two symmetrical pieces 37 are depicted, it will be understood that the number of pieces 37 will be a function of the number of inlets 29.

This embodiment of the rotary obturator 35 has been selected with regard to manufacturing advantages. It advantageously fulfills its function although the opposition of the phases of the two pairs of jets is not perfect.

The operation principle of the cyclic modulator 18, as well as the generation of the fluid motion in the bath, according to the principle of reversible couples of sources and sinks, can be analyzed with the help of the FIGS. 3*a*, 3*b* and 4*a*, 4*b*.

The obturator 35 is rotated by the servomotor 23 through the intermediary of the cylinder 19 and, at the moment $t_o$, it partially closes the two diametrically opposed inlets 29A, whereas it leaves entirely free the access to the two other diametrically opposed inlets 29B which are set off by an angle of 90° with respect to the two first outlets (see FIG. 4*a*). As a result thereof, the flow rate is at a minimum in the two tuyeres 30A connected to the two inlets 29A, whereas it is at a maximum in the two tuyeres 30B connected to the two inlets 29B (see FIG. 3*a*). During a first 180° revolution after the moment to, the flow rate will increase in the two tuyeres 30A and decrease in the two tuyeres 30B. The impact zones of the jets A1, A2 coming out of the tuyeres 30A make up the sources and the impact zones of the jets B1, B2 coming out of the tuyeres 30B make up the sinks (see FIG. 3*a*). Consequently a flow of material is established in the bath between the source zones and the sink zones. After having completed the first 180° revolution the obturator 35 closes to a maximum the pair of inlets 29B and it completely frees the access to the pair of inlets 29A (see FIG. 4*b*). As a result thereof the flow is now at a maximum in the tuyeres 30A and at a minimum in the tuyeres 30B.

During a second 180° revolution, which brings the obturator back into its initial position at the moment $t_o$, the flow rate will increase in the two tuyeres 30B and decrease in the two tuyeres 30B. The impact zones of the jets B1, B2 coming out of the tuyeres 30B are making up sources and the impact zones of the jets Al, A2 coming out of the tuyeres 30A are making up sinks. The material flow in the bath is consequently reversed as compared to the situation pertaining to the first 180° revolution (see FIG. 3*b*).

This preferred embodiment of the lance has the advantage that the radial forces (perpendicular to the axis of the lance), exerted onto the blowing head 3 by the jets leaving the lance under an angle $\alpha$ with respect to the vertical direction, have a resultant equal to zero at any moment of the cycle. The lance according to the preferred embodiment is consequently not exposed to lateral stresses due to the jets during its operation.

In addition the lance may also have several post-combustion tuyeres 34 which are located on a circumference around the orifices of the tuyeres dispensing the primary refining gas. These post-combustion tuyeres 34 are connected to a secondary gas flow in the annular space between the walls 6 and 7 of the mantle of the lance 1.

The present invention supplies, in view of operating a refining process, a blowing lance which allows creation in the bath of fluid motion favouring the rush of material towards the impact spots of the gas jets and it increases the stirring of the liquid bath during its refining treatment, without thereby creating at the impact points of the jets, situations of overconcentration of the oxidizing gas and/or of local overheating.

The invention achieves, despite a simple mechanical design, metallurgical results which are at least equal to the results achieved with the prior art revolving jets lances, having a much more complicated mechanical design.

As the dome 32, which is constituting the extremity of the lance facing the liquid bath, is completely water cooled, the blowing head is characterized by a high lifetime.

All the movable parts are under shelter in the interior of the lance which is integrally water cooled and they are thus protected against the extremely severe environment prevailing above the surface of the metal bath.

Another advantage lies in the fact that the modulating device 18 can be added easily to an already existing lance.

Although the invention has been described in conjunction with a preferred embodiment, it will be understood that the invention may be practiced by using a number of jets which is higher or lower than four, or by selecting different shifts of the cycles between the flow rates in the jets, or by operating with other modulating functions (flow rate/time).

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A blowing lance for refining metals comprising:

adjustable tuyere means for generating a supersonic refining gas flow having a flow rate and a speed which are independently adjustable;

blowing head means having a front dome;

a plurality of fixed tuyere means opening into said front dome of said blowing head means and dividing the refining gas flow into individual free jets;

cyclic modulator means for varying the flow rate of the refining gas through said fixed tuyere means, said cyclic modulator means being adapted for progressively obturating a first set of said fixed tuyere means for the passage of the refining gas and for simultaneously and progressively freeing a second set of said fixed tuyere means for the passage of the refining gas during a first part of a modulating cycle and during a second part of said modulation cycle and cyclic modulator means being adapted for progressively freeing said first set of said fixed tuyere means and for simultaneously and progressively obturating said second set of said fixed tuyere means; and wherein said plurality of fixed tuyere means comprises a multiple of 2n of said fixed tuyere means, where n comprises an integer greater than or equal to two, said fixed tuyere means being arranged so as to produce 2n free jets, said 2n free jets defining an angle relative to a longitudinal axis of the blowing lance, said angle being substantially the same for each of said 2n free jets, and two successive said fixed tuyere means being spaced apart by an angle of 180/n degrees, said cyclic modulator being adapted to obturate to a maximum the passage through a first of two successive fixed tuyeres, when freeing at a maximum the second of said successive fixed tuyere.

2. The blowing lance of claim 1, wherein said cyclic modulator means comprises a rotary obturator;

means for rotating said rotary obturator;

inlet means defining separate inlets to each of said fixed tuyere means; and wherein said rotary obturator is disposed in the refining gas flow upstream of and in direct juxtaposition with said inlet means.

3. The blowing lance of claim 2, wherein said means for rotating said rotary obturator comprises:

a hollow cylinder coaxial with a longitudinal axis of the blowing lane, said cylinder having a first end fixed to said rotary obturator;

a servomotor situated upstream of said rotary obturator; and coupling means between said servomotor and a second end of said cylinder for conferring to said cylinder a rotary movement around the longitudinal axis of the lance.

4. The blowing lance of claim 2 wherein:

said rotary obturator is subdivided by n/2 plans passing through its rotation axis, where n includes an integer greater than or equal to two, into n angular sectors defining an angle of 360/n degrees and having a substantially similar geometric shape, said inlet means is subdivided into n identical angular sectors, each of said sectors comprising said inlets of two of said fixed tuyere means, the sectors of the rotary obturator show, at their end facing said inlet means, a terminal cross section conceived in such a way that the inlet of one of the two of said fixed tuyere means of a corresponding sector of the inlet means is more or less shut for the flow of the refining gas by said terminal section, when the inlet of the other of said fixed tuyere means of the same sector is entirely, or near entirely, free for the flow of the refining gas.

5. The blowing lance as claimed in claim 1, wherein said adjustable tuyere means comprises:

a Laval shaped tuyere conferring a supersonic speed to the refining gas flow including control means for varying the geometrical characteristics of said adjustable tuyere means.

6. The blowing lance of claim 5, wherein said control means of said Laval shaped tuyere comprises servomotors.

7. The blowing lance of claim 3, wherein said servomotor comprises electrical parts which are shielded in an environment of a neutral gas under a slight overpressure with respect to said refining gas.

8. The blowing lance of claim 1, wherein said blowing head further comprises:

post-combustion tuyeres connected to a subsonic secondary flow of said refining gas.

9. The blowing lance of claim 1, wherein the blowing lance further comprises a mantle; and water cooling circuits disposed in said mantle as well as in said front dome of the blowing head.

10. A blowing lance for refining metals comprising:

adjustable tuyere means for generating a supersonic refining gas flow having a flow rate and a speed which are independently adjustable;

blowing head means having a front dome;

a plurality of fixed tuyere means opening into said front dome of said blowing head means and dividing the refining gas flow into individual free jets;

cyclic modulator means for varying the flow rate of the refining gas through said fixed tuyere means, said cyclic modulator means being adapted for progressively obturating a first set of said fixed tuyere means for the passage of the refining gas and for simultaneously and progressively freeing a second set of said fixed tuyere means for the passage of the refining gas during a first part of a modulation cycle and during a second part of said modulation cycle said cyclic modulator means being adapted for progressively freeing said first set of said fixed tuyere means and for simultaneously and progressively obturating said second set of said fixed tuyere means;

wherein said cyclic modulator means comprises a rotary obturator, means for rotating said rotary obturator, inlet means defining separate inlets to each of said fixed tuyere means, and wherein said rotary obturator is disposed in the refining gas flow upstream of an in direct juxtaposition with said inlet means; and wherein said means for rotating said rotary obturator comprises, a hollow cylinder coaxial with a longitudinal axis of the blowing glance, said cylinder having a first end fixed to said rotary obturator, a servomotor situated upstream of said rotary obturator, and coupling means between said servomotor and a second end of said cylinder for conferring to said cylinder a rotary movement around the longitudinal axis of the lance.

11. The blowing lance of claim 10, wherein:

said rotary obturator is subdivided by n/2 plans passing through its rotation axis, where n includes an integer greater than or equal to two, into n angular sectors defining an angle of 360/n degrees and having a substantially similar geometric shape, said inlet means is subdivided into n identical angular sectors, each of said sectors comprising said inlets of two of said fixed tuyere means, the sectors of the rotary obturator show, at their end facing said inlet means, a terminal cross section conceived in such a way that the inlet of one of the two of said fixed tuyere means of a corresponding sector of the inlet means is more or less shut for the flow of the refining gas by said terminal section, when the inlet of the other of said fixed tuyere means of the same sector is entirely, or near entirely, free for the flow of the refining gas.

12. The blowing lance as claimed in claim 10, wherein said adjustable tuyere means comprises:

a Laval shaped tuyere conferring a supersonic speed to the refining gas flow including control means for varying the geometrical characteristics of said adjustable tuyere means.

13. The blowing lance of claim 12, wherein said control means of said Laval shaped tuyere comprises servomotors.

14. The blowing lance of claim 10, wherein said servomotor comprises electrical parts which are shielded in an environment of a neutral gas under a slight overpressure with respect to said refining gas.

15. The blowing lance of claim 10, wherein said blowing head further comprises:

post-combustion tuyeres connected to a subsonic secondary flow of said refining gas.

16. The blowing lance of claim 10, wherein the blowing lance further comprises a mantle; and water cooling circuits disposed in said mantle as well as in said front dome of the blowing head.

17. A blowing lance for refining metals comprising:

adjustable tuyere means for generating a supersonic refining gas flow having a flow rate and a speed which are independently adjustable;

blowing head means having a front dome;

a plurality of fixed tuyere means opening into said front dome of said blowing head means and dividing the refining gas flow into individual free jets;

cyclic modulator means for varying the flow rate of the refining gas through said fixed tuyere means, said cyclic modulator means being adapted for progressively obturating a first set of fixed tuyere means for the passage of the refining gas and for simultaneously and progressively freeing a second set of said fixed tuyere means for the passage of the refining gas during a first part of a modulation cycle and during a second part of said modulation cycle said cyclic modulator means being adapted for progressively freeing said first set of said fixed tuyere means and for simultaneously and progressively obturating said second set of said fixed tuyere means;

wherein said cyclic modulator means comprises a rotary obturator, means for rotating said rotary oburator inlet means defining separate inlets to each of said fixed tuyere means, and wherein said rotary obturator is disposed in the refining gas flow upstream of an in direct juxtaposition with said inlet means; and wherein said rotary obturator is subdivided by n/2 plans passing through its rotation axis, where n includes an integer greater than or equal to two, into n angular sectors defining an angle of 360/n degrees and having a substantially similar geometric shape, said inlet means is subdivided into n identical angular sectors, each of said sectors comprising said inlets of two of said fixed tuyere means, the sectors of the rotary obturator show, at their end facing said inlet means, a terminal cross section conceived in such a way that the inlet of one of the two of said fixed tuyere means of a corresponding sector of the inlet means is more or less shut for the flow of the refining gas by said terminal section, when the inlet of the other of said fixed tuyere means of the same sector is entirely, or nearly entirely, free for the flow of the refining gas.

18. The blowing lance as claimed in claim 17, wherein said adjustable tuyere means comprises:

a Laval shaped tuyere conferring a supersonic speed to the refining gas flow including control means for varying the geometrical characteristics of said adjustable tuyere means.

19. The blowing lance of claim 18, wherein said control means of said Laval shaped tuyere comprises servomotors.

20. The blowing lance of claim 17, wherein said blowing head further comprises:

post-combustion tuyeres connected to a subsonic secondary flow of said refining gas.

21. The blowing lance of claim 17, wherein the blowing lance further comprises a mantle; and water cooling circuits disposed in said mantle as well as in said front dome of the blowing head.

* * * * *